US010145017B2

(12) United States Patent
Wang et al.

(10) Patent No.: US 10,145,017 B2
(45) Date of Patent: Dec. 4, 2018

(54) EFFICIENT ELECTROLYSIS SYSTEM FOR SODIUM CHLORATE PRODUCTION

(71) Applicant: GuangXi University, Nanning (CN)

(72) Inventors: Shuangfei Wang, Nanning (CN); Chengrong Qin, Nanning (CN); Xusheng Li, Nanning (CN); Chen Liang, Nanning (CN); Xinliang Liu, Nanning (CN); Zhiwei Wang, Nanning (CN)

( * ) Notice: Subject to any disclaimer, the term of this patent is extended or adjusted under 35 U.S.C. 154(b) by 0 days.

(21) Appl. No.: 16/001,267

(22) Filed: Jun. 6, 2018

(65) Prior Publication Data

US 2018/0282883 A1 Oct. 4, 2018

Related U.S. Application Data

(62) Division of application No. 15/589,514, filed on May 8, 2017.

(30) Foreign Application Priority Data

Jun. 7, 2016 (CN) ..... 2016 1 0396231

(51) Int. Cl.
*C25B 9/06* (2006.01)
*C25B 9/00* (2006.01)
(Continued)

(52) U.S. Cl.
CPC ..... *C25B 1/265* (2013.01); *C25B 9/18* (2013.01); *C25B 15/08* (2013.01)

(58) Field of Classification Search
CPC ..... C25B 1/265; C25B 15/08; C25B 15/00; C25B 9/06; C25B 9/00
(Continued)

(56) References Cited

U.S. PATENT DOCUMENTS 3,463,722 A 8/1969 Westerlund
3,801,480 A * 4/1974 Krieg ..... C25B 1/36 205/527
(Continued)

OTHER PUBLICATIONS

Zulmariam Mendez, "Notice of Allowance", dated Aug. 10, 2018, U.S. Appl. No. 15/589,514.
(Continued)

*Primary Examiner* — Zulmariam Mendez
(74) *Attorney, Agent, or Firm* — LeonardPatel PC

(57) ABSTRACT

An efficient electrolysis system for sodium chlorate production may include round or oval cells, reactors, a product pump transfer, a buffer tank, a circulation pump, and explosive clad plate, all of which are connected by way of pipelines. Inlet and the outlet of each cell are separately connected with the reactor via titanium pipes, allowing the electrolyte to recirculate naturally between the cells and the reactors. The outlet of every cell is conical while each reactor includes a standard electrolytic unit with three to eight cells. The electrolytic units are modularly identical and symmetrically linked to the buffer tank. Within each unit, adjacent cells are connected with the explosive clad plates. The buffer tank may be divided into two parts—part A and part B—with part A connecting with the overflow port of the reactor via pipeline, and the part B connecting with the reactor via the circulation pump. Part B is equipped with a refined brine feed pipe on the top, the bottom of part A connects with a product transfer pump (3) via pipeline.

2 Claims, 3 Drawing Sheets

(51) Int. Cl.

| | |
|---|---|
| ***C25B 15/00*** | (2006.01) |
| ***C25B 1/26*** | (2006.01) |
| ***C25B 15/08*** | (2006.01) |
| ***C25B 9/18*** | (2006.01) |

(58) Field of Classification Search
USPC ..... 205/503
See application file for complete search history.

(56) References Cited

U.S. PATENT DOCUMENTS

| | | | | | |
|---|---|---|---|---|---|
| 3,824,172 | A | | 7/1974 | Hodges | |
| 4,061,550 | A | * | 12/1977 | Cook, Jr. ..... | C25B 1/34<br>205/518 |
| 4,326,941 | A | | 4/1982 | Westerlund | |

OTHER PUBLICATIONS

Zulmariam Mendez, "Restriction Requirement", dated Apr. 6, 2018, U.S. Appl. No. 15/589,514.

* cited by examiner

EFFICIENT ELECTROLYSIS SYSTEM FOR SODIUM CHLORATE PRODUCTION

CROSS-REFERENCE TO RELATED APPLICATION

This application is a divisional of, and claims the benefit of, U.S. patent application Ser. No. 15/589,514, filed on May 8, 2018, which claims the benefit of Canadian Patent Application No. 2946015, filed on Oct. 14, 2016, which claims priority to Chinese Patent Application No. CN 201610396231.8, filed on Jun. 7, 2016. The subject matter thereof is hereby incorporated herein by reference in its entirety.

FIELD

The present invention relates to electrolysis of sodium chlorate production, and more particularly, to an electrolysis system for efficiently producing sodium chlorate.

BACKGROUND

Sodium chlorate, with a chemical formula of $NaClO_3$ and a molecular weight of 106.44, is normally a white or yellowish equiaxed crystal powder, that has a salty and cool taste. Sodium chlorate is also soluble in water and slightly soluble in ethanol. Sodium chlorate is a strongly oxidant in acidic solutions, and decomposes above 300° C. to release oxygen. Being unstable, sodium chlorate is prone to burning or explosion when mixed or contacted with phosphorus, sulfur and organic matters. Sodium chlorate is also hygroscopic, easily caking and toxic.

Sodium chlorate has a wide range of applications, including chlorine dioxide production in industries, e.g., used as an oxidizing agent, as a dye, etc., to produce sodium chlorite and sodium perchlorate in inorganic industries, to produce medicinal zinc oxide and sodium dimercaptosucinate in the pharmaceutical industry, and to produce zinc oxide in the pigment industry and as herbicide in agriculture. In addition, sodium chlorate is also found in paper making, tanning, mineral processing, extraction of bromine from seawater, ink making, explosive making, etc.

Currently, the most common method to produce sodium chlorate is through an electrolysis process, where the raw material refined brine is electrolyzed in electrolyzer cells to produce a sodium chlorate solution. The electrolytic reaction is given by $$NaCl+3H_2O \rightarrow NaClO_3+3H_2$$

FIG. 2 is related art showing a conventional electrolysis system 200 for sodium chlorate production. Electrolysis system 300 includes a round (or oval) cell 201, a reactor 202, a product pump transfer 203, a buffer tank 204, a circulation pump 205, a refined brine feed pipe 206, a hydrogen discharge pipe 207, an explosive clad plate 208, a first chlorate feed header 209, and a second chlorate feed header 210. In conventional electrolysis systems, such as electrolysis system 200, for sodium chlorate production, the cells are arranged symmetrically in two rows, and the electrolyte is distributed from the reactor to the bottom of the two rows of the cells via feed headers. The electrolyte is subsequently fed to each cell via branches that are connected to the feed headers in parallel. As a result, the amount of electrolyte fed to each cell differs and the recirculation is poor. The more cells each feed header feeds, the poorer the recirculation and the lower electrolytic efficiency. This situation is limiting the number of cells in each group and restricting the increase in production capacity.

Thus, an alternative system may be beneficial.

SUMMARY

Certain embodiments of the present invention may provide solutions to the problems and needs in the art that have not yet been fully identified, appreciated, or solved by current electrolysis systems. For example, some embodiments generally pertain to an efficient electrolysis system for sodium chlorate production, improving the recirculation of electrolyte, increasing electrolytic efficiency, and solving the problem of restricted production capacity.

In one embodiment, . . . <FOR SHEETAL TO COMPLETE AFTER COMMENTS>

In another embodiment, . . . <FOR SHEETAL TO COMPLETE AFTER COMMENTS>

In yet another embodiment, . . . <FOR SHEETAL TO COMPLETE AFTER COMMENTS>

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1A:
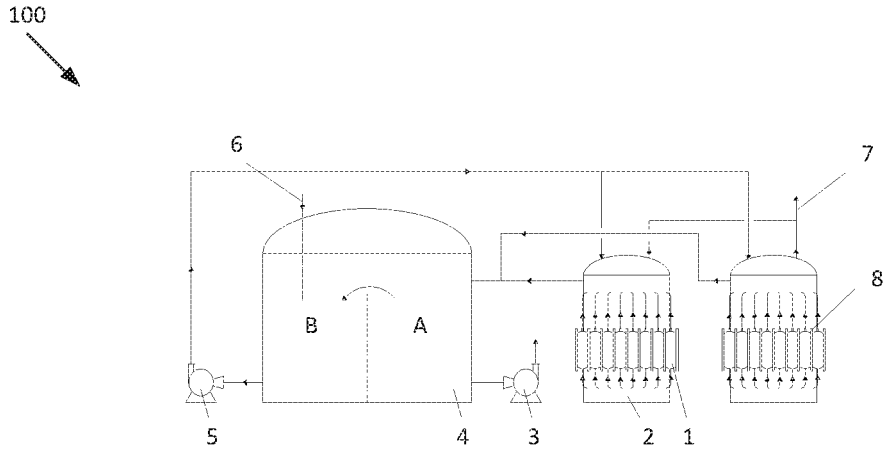
FIG. 1A is an elevation view illustrating an efficient electrolysis system for sodium chlorate production, according to an embodiment of the present invention.
Figure 1B:
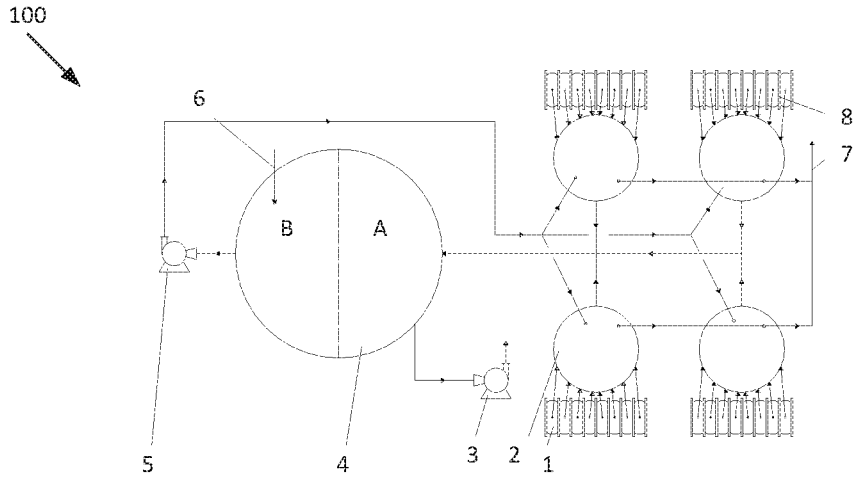
FIG. 1B is a top view illustrating an electrolysis system for sodium chlorate production, according to an embodiment of the present invention.
Figure 2:
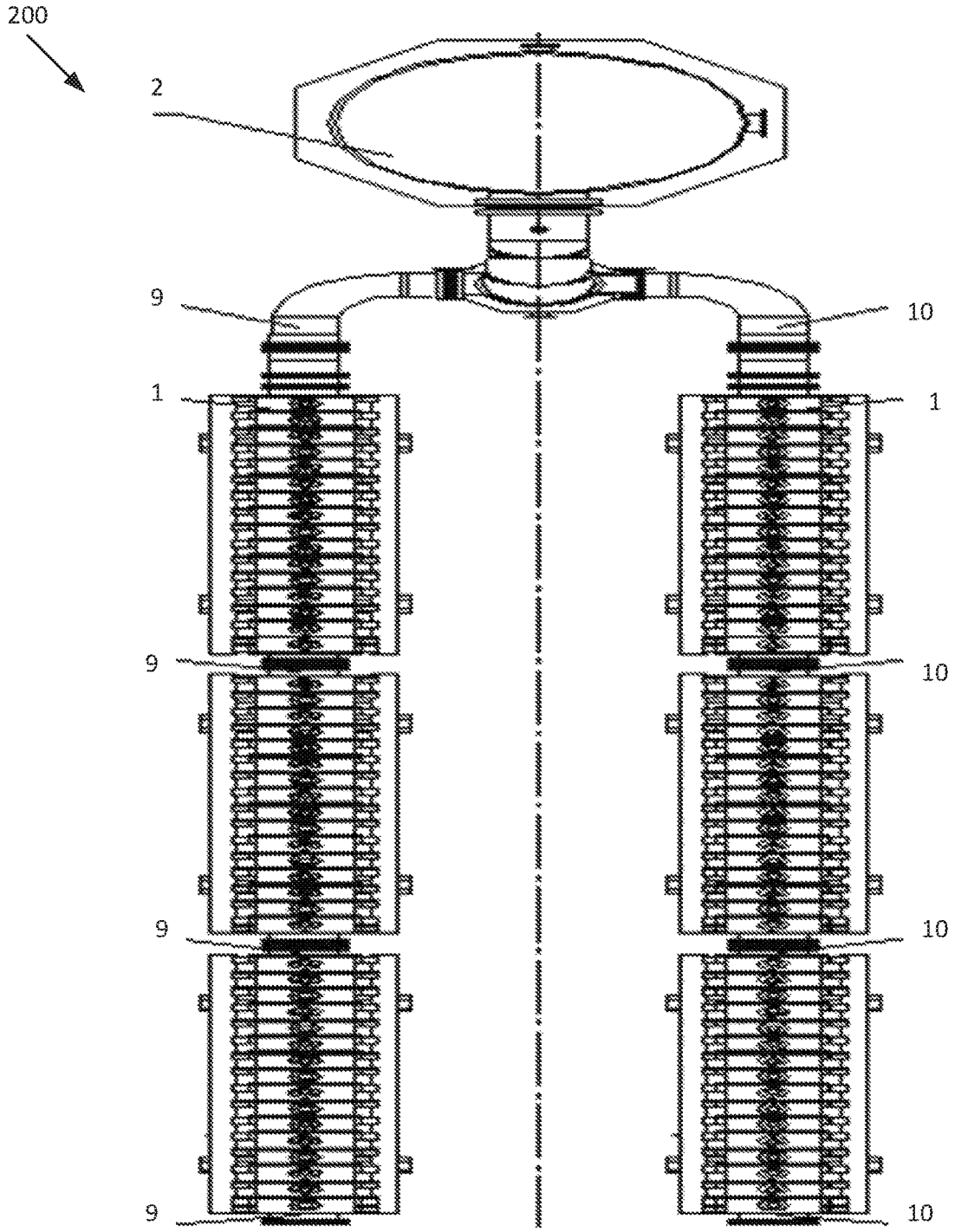
FIG. 2 is related art showing a top view of a conventional electrolysis system for sodium chlorate.

FIGS. 1A and 1B illustrate an efficient electrolysis system (the "system") 1 for sodium chlorate production, according to an embodiment of the present invention. System 1 may include round (or oval) cells 1, reactors 2, a product transfer pump 3, a buffer tank 4, a circulation pump 5, and explosive clad plates 8 connected together through one or more pipelines. Inlet and outlet of each cell 1 are separately connected to reactor 2 via titanium pipes. The outlets of cells are conical in some embodiments. Each reactor 2 connects with a standard electrolytic unit of 5-8 cells 1 to comprise of a standard electrolytic unit with 25-30 $m^2$ of anode area.

Electrolytic units are modularly identically and symmetrically linked to buffer tank 4 for the entire sodium chlorate electrolytic system. Within each electrolytic unit, adjacent cells 1 are connected with explosive clad plates 8, optimizing space and currency loss by removing aluminum bars or copper bars between each cell 1. Buffer tank 4 is divided into part A and B inside. For instance, part A of buffer tank 4 is connected with an overflow port of reactor 2 via the one or more pipelines, while part B is connected with reactor 2 via circulation pump 5. In certain embodiments, part B is equipped with a refined brine feeding pipe 6 on the top; the and bottom of part A of buffer tank 4 is connected with a product transfer pump 3 via the one or more pipelines.

In some embodiments, the inlet and the outlet of each cell 1 are separately connected with reactor 2 via the titanium pipes. The outlets of cells 1 are conical in certain embodiments. Also, in some embodiments, several cells 1 may form a standard electrolyzer within a natural circulation system. This may to prevent electrical corrosion resulted by stray current from cells 1. In these embodiments, the number of cells 1 of a standard electrolyzer may not be less than 3 and not more than 8, and the area of each cell 1 may be 25-30 $m^2$. Electrolytic units may be modularly identical and symmetrically linked to buffer tank 4 for the entire sodium chlorate electrolytic system 100. Adjacent cells may also be connected by explosive clad plates 8 and the liquor outlets of cells 1 be of oval structures. To discharge hydrogen in reactor 2, reactor 2 is equipped with a hydrogen discharge pipe 7 on the top, for example.

In some embodiment, an efficient electrolysis process for producing sodium chlorate may include introducing the refined brine to part B of the buffer tank 4 at startup, and sending to reactor 2 by circulation pump 5 to enter the cells for electrolysis. Next, the electrolyte enters reactor 2 for reaction, ending up with 550-650 g/l sodium chlorate and 95-105 g/l sodium chloride. Electrolyte may overflow into part A of buffer tank 4 and may be transferred to the de-hypo process by the product transfer pump 3. Also, hydrogen within reactor 2 may be sent to the next stage.

The refined brine may then enter part B of buffer tank 4 continuously from refined brine feed pipe 6 to mix with electrolyte overflowed from part A. Transferred by circulation pump 5, the mixed liquor enters reactors 2 and cells 1 for electrolysis and reaction, generating an electrolyte that include 550-650 g/l sodium chlorate and 95-105 g/l sodium chloride continuously.

In some embodiments, round or oval shaped cells are adopted, inside which flow of electrolyte is more uniform. The inlet and the outlet of each cell are separately connected with the reactor via titanium pipes, forming separate natural circulation channels to render the circulation more uniform. This way, not only is the problem of inconsistent electrolyte feed amount in each cell arising from sharing the same feed header when feeding electrolyte that exists in conventional electrolysis systems for sodium chlorate solved, but also the electrolytic efficiency is improved by 2-3 percent.

In some further embodiments, each group of cells includes 3 to 8 cells. For a group, the increase in the number of cells increases stray current generated during the production and causes electroerosion. However, if there were fewer cells, the capacity of a group would be too low, and the production line would require a larger space.

In some other embodiments, adjacent cells in each electrolytic unit are connected with explosive clad plates instead of aluminum bars or copper bars, optimizing space and currency loss between cells. In yet some additional embodiments, the electrolytic units are modularly identical and symmetrically linked to the buffer tank. Also, configuration of a sodium chlorate production line may be flexibly modified as per capacity demand. For example, if there is a need to increase the capacity, the number of cell groups may be increased. In yet some further embodiments, maintenance is easy, and faulty cell groups can be isolated and replaced entirely.

The following embodiments may provide an efficient electrolysis system for sodium chlorate. The following examples are for the purposes of illustrating the technical framework and characteristics of some embodiments described herein to make details understandable to those unfamiliar with it. These examples do not in any manner limit the protection scope for the embodiments.

EXAMPLE 1

An efficient electrolysis system for sodium chlorate production may include round or oval cells 1, reactors 2 and a buffer tank 4. The inlet and the outlet for each cell 1 are separately connected with a reactor 2 via titanium pipes and each cell 1 is arranged in two rows. Buffer tank 4 is divided into parts—part A and part B—with part A connected with the overflow port of reactor 2 via pipeline, and part B connected to the pipeline of reactor 2 via a circulation pump 5. and equipped with a brine feeding pipe 6 on the top. The bottom of part A is connected with a product transfer pump 3 via pipeline. The top of reactor 2 is connected with a hydrogen discharge pipe 7. Each reactor 2 is accompanied by 6 round cells, with an anode area for each cell being 30 $m^2$.

During operation, refined brine is added into part B at startup, and the refined brine is then led to reactor 2 by circulation pump 5 to enter cells 1 for electrolysis. Electrolyte enters reactor 2 for reaction, ending up with 590 g/l sodium chlorate and 105 g/l sodium chloride. Electrolyte overflows into part A and is transferred to the de-hypo process by the product transfer pump 3. Hydrogen in the reactor 2 is then sent to the next stage.

Refined brine may enter part B continuously from refined brine feed pipe 6, such that the refined brine mixes with electrolyte overflowed from part A. Transferred by circulation pump 5, the mixed liquor may enter reactors 2 and cells 1 for electrolysis and reaction. This may generate an electrolyte that include 590 g/l sodium chlorate and 105 g/l sodium chloride continuously. Each group of cells may produce 7.88 t sodium chlorate per day (on a 24 hour basis), and by using 20 groups (120 cells in total), daily production is 157 t.

EXAMPLE 2

An efficient electrolysis system for sodium chlorate production may round or oval cells 1, reactors 2 and a buffer tank 4. The inlet and the outlet of each cell 1 are separately connected with reactor 2 via titanium pipes and cells 1 are arranged in two rows. The buffer tank is divided into two parts—part A and part B—with part A being connected with an overflow port of reactor 2 via pipeline and part B being connected to the pipeline of reactor 2 via circulation pump 5 and equipped with a brine feeding pipe 6 on the top. The bottom of part A is connected with a product transfer pump 3 via pipeline. The top of reactor 2 is connected with a hydrogen discharge pipe 7. Each reactor is accompanied by 7 round cells with an anode area for each cell being 30 $m^2$, for example.

During operation, the efficient electrolysis system for sodium chlorate production may add refined brine into part B at startup, and the refined brine is then led to reactor 2 by a circulation pump 5 to enter the cells 1 for electrolysis. Electrolyte may enter reactor 2 for reaction, ending up with 600 g/l sodium chlorate and 100 g/l sodium chloride.

Electrolyte may overflow into part A and is transferred to the de-hypo process by product transfer pump 3. Hydrogen in the reactor 2 may be sent to the next stage. Refined brine may enter part B continuously from refined brine feed pipe 6 such that the refined brine mixes with the electrolyte overflowing from part A. Transferred by circulation pump 5, the mixed liquor enters reactors 2 and cells 1 for electrolysis and reaction, generating an electrolyte that include 600 g/l sodium chlorate and 100 g/l sodium chloride continuously. Each group of cells (1) may produce 9.2 t sodium chlorate per day (on a 24 hour basis), and by using 20 groups (140 cells in total), daily production may be 184 t.

EXAMPLE 3

An efficient electrolysis system for sodium chlorate production may include round or oval cells 1, reactors 2, and a buffer tank 4. The inlet and the outlet of each cell 1 are separately connected with reactor 2 via titanium pipes and cells 1 are arranged in two rows. Buffer tank 4 is divided in some embodiments into two parts—part A and part B—with part A connected with the overflow port of reactor 2 via pipeline, while part B is connected to the pipeline of reactor 2 via a circulation pump 5 and equipped with a brine feed pipe 6 on the top. The bottom of part A is connected with a product transfer pump 3 via pipeline. The top of reactor 2 is connected with a hydrogen discharge pipe 7. Each reactor 2 is accompanied by 8 round cells with an anode area of 30 $m^2$ for each cell, for example.

During operation, the efficient electrolysis system for sodium chlorate production may add refined brine into part B during startup, and the refined brine may then be introduce to reactor 2 by circulation pump 5 to enter cells 1 for electrolysis. Electrolyte may enter reactor 2 for reaction, ending up with 610 g/l sodium chlorate and 95 g/l sodium chloride. The electrolyte overflowed into part A is transferred to the de-hypo process by product transfer pump 3. Hydrogen produced in reactor 2 is sent to the next stage.

Refined brine may enter part B continuously from refined brine feed pipe 6 to mix with electrolyte overflowed from part A. Transferred by circulation pump 5, the mixed liquor may enter reactors 2 and cells 1 for electrolysis and reaction, generating an electrolyte that includes 610 g/l sodium chlorate and 95 g/l sodium chloride continuously. Each group of cells may produce 10.5 t sodium chlorate per day (on a 24 hour basis), and by using 20 groups (160 cells in total), daily production is 210 t, in some embodiments.

Comparison 1

In running plants with conventional sodium chlorate electrolysis systems, to ensure uniformity and fluidity of the electrolyte distributed to each cell, one reactor (i.e., one production line) is arranged to work with 96 round or oval cells with an anode area of 30 $m^2$ for each cell at most. 2 or more lines are always arranged in cases where there are more than 96 cells. If one reactor is arranged to work with over 96 cells, the cells further away from the reactor may receive insufficient flow or may even be void of flow. Production capacity (on a 24 hour basis) for a line with 96 round or oval cells with an anode area of 30 $m^2$ for each cell is 122 t per day.

In some embodiments, an efficient electrolysis system for sodium chlorate production is provided. The electrolysis system may include one reactor that is connected with 8 round or oval cells, 96 cells in 12 groups in total, with an anode area of 30 $m^2$ for each cell. This way, production capacity (on a 24 hour basis) is increased to 126 t per day.

Comparison 2

Also, in the case of a conventional sodium chlorate electrolysis system, for a line with 84 cells with an anode area of 30 $m^2$ per cell, the production capacity (on a 24 hour basis) is 106 t per day. By using an efficient electrolysis system for sodium chlorate production, the production capacity (on a 24 hour basis) can be increased to 110 t per day. For example, one reactor is connected with 7 round or oval cells, which is 84 cells in 12 groups in total with an anode area of 30 $m^2$ per cell. This allows the production capacity to increase to 110 t per day.

Comparison 3

In the case of a conventional sodium chlorate electrolysis system, for a line with 72 cells with an anode area of 30 $m^2$ per cell, the production capacity (on a 24 hour basis) is 91.6 t per day.

In some embodiments, the electrolysis system for sodium chlorate production may include a reactor connected with 7 round or oval cells, i.e., 72 cells in 12 groups in total with an anode area of 30 $m^2$ per cell, to increase the production capacity (on a 24 hour basis) to 94.5 t per day.

By way of the above comparison, the electrolysis system for sodium chlorate production can fulfill greater production capacity based on equivalent specifications and the same number of cells, meaning higher electrolytic efficiency. Furthermore, the capacity of this system can be expanded by increasing the number of cell groups, while for conventional electrolysis systems for sodium chlorate production does not have the same benefit. For example, when expanding the capacity by increasing the number of cell groups, each feed headers will feed more cells, resulting in poorer circulation and lower electrolytic efficiency.

It will be readily understood that the components of various embodiments of the present invention, as generally described and illustrated in the figures herein, may be arranged and designed in a wide variety of different configurations. Thus, the detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An electrolysis process for producing sodium chlorate, comprising:

introducing refined brine into part B of a buffer tank during startup such that the refined brine is sent to a reactor by way of a circulation pump, facilitating the entering of the refined brine to a plurality of cells for electrolysis.

introducing electrolyte into the reactor for reaction, to end up with 550-650 g/l sodium chlorate and 95-105 g/l sodium chloride, wherein the electrolyte overflows into part A of the buffer tank and is transferred to a de-hypo process by way of product transfer pump and hydrogen in the reactor is sent to next stage;

continuously entering refined brine into the part B of the buffer tank continuously from the refined brine feeding pipe to mix with the overflowing electrolyte, and transferring, by way of the circulation pump, mixed liquor to enter the reactor and the plurality of cells for electrolysis and reaction, thereby generating an electrolyte that continuously includes 550-650 g/l sodium chlorate and 95-105 g/l sodium chloride.

2. The process of claim 1, wherein the electrolyte undergoes natural circulation between the plurality of cells the and reactor, and undergoes forced circulation between the buffer tank and the reactor with the circulation pump.

* * * * *